US005647241A

United States Patent [19]

Ruple et al.

[11] Patent Number: 5,647,241

[45] Date of Patent: Jul. 15, 1997

[54] ROTARY UPPER ROLL SELECTOR

[75] Inventors: Lewis H. Ruple, Perrysburg; Susan J. Taber, Gibsonburg, both of Ohio

[73] Assignee: Abbey Etna Machine Company, Perrysburg, Ohio

[21] Appl. No.: 532,301

[22] Filed: Sep. 22, 1995

[51] Int. Cl.[6] ..... B21D 5/12

[52] U.S. Cl. ..... 72/178; 72/52; 72/226

[58] Field of Search ..... 72/226, 185, 52, 72/51, 178

[56] References Cited

U.S. PATENT DOCUMENTS

| | | | |
|---|---|---|---|
| 494,904 | 4/1893 | Story | 72/226 |
| 3,318,130 | 5/1967 | Sendzimir | 72/226 |
| 3,707,257 | 12/1972 | Wogerbauer et al. . | |
| 4,142,663 | 3/1979 | Blatnik et al. | 72/186 |
| 4,260,096 | 4/1981 | Samarynov et al. | 72/235 |
| 4,530,225 | 7/1985 | Meurer et al. | 72/52 |
| 4,584,169 | 4/1986 | Werner et al. . | |
| 4,709,845 | 12/1987 | Akiyama et al. . | |
| 4,796,798 | 1/1989 | Tsuta et al. . | |
| 4,945,743 | 8/1990 | Yasumura et al. | 72/181 |
| 5,107,695 | 4/1992 | Vandenbroucke | 72/226 |
| 5,301,869 | 4/1994 | Toyooka et al. | 72/181 |

FOREIGN PATENT DOCUMENTS

| | | | |
|---|---|---|---|
| 3041 | 1/1980 | Japan | 72/226 |
| 166308 | 9/1984 | Japan | 72/226 |
| 202122 | 11/1984 | Japan | 72/52 |
| 133929 | 7/1985 | Japan | 72/52 |
| 178221 | 6/1992 | Japan | 72/52 |
| 294825 | 10/1992 | Japan | 72/52 |
| 31530 | 2/1993 | Japan | 72/178 |

*Primary Examiner*—Daniel C. Crane
*Attorney, Agent, or Firm*—Donald R. Fraser

[57] ABSTRACT

A tube forming machine having at least two upper forming roll members in the breakdown section which may be selectively indexed into cooperative working relation with a lower forming roll member to produce different size tubes without the necessity of physically removing the upper forming roll member and replacing the same with another forming roll member of a different configuration.

3 Claims, 3 Drawing Sheets

ROTARY UPPER ROLL SELECTOR

BACKGROUND OF THE INVENTION

1. Field of the Invention

The present invention pertains generally to a mill for the manufacture of continuous seam-welded tubes or pipes, and more particularly to an automated system for rapidly changing such a mill from the production of one size of shape of tube to production of tube of another and different size or shape.

2. Description of the Prior Art

In accordance with a well known process for producing seam-welded tubes, a continuous strip or skelp is advanced through forming apparatus comprising a series of forming rolls and progressively deformed into a tubular form having an open, longitudinally extending seam. The tubular form then advances through a welding station wherein the adjacent longitudinal edges are urged together and joined by a suitable welding process. The welded tube may then have the raised weld bead removed from its surfaces and, after passing through a cooling zone, pass through a series of shaping and sizing rollers whereby it is formed to the final configuration and size. The advancing continuous tube is then severed by means of a travelling cutting unit into individual sections of a predetermined length.

The machines are designed to be capable of conversion to production of various sizes and cross-sectional configurations of tubes and pipes. As will be readily appreciated, such machines are massive precision machines representing a considerable capital investment. Heretofore in converting from production of tubing of one size or shape to another, the line was shut down and the various components were individually removed and replaced by components required for production of the next product. The replacement components then had to be properly set and adjusted on the line before production could resume. This entire changeover routine could consume a considerable period of time, typically five or six hours or more. The changeover thus involves a considerable expenditure in time and money, and an extensive loss of production. As a result, it becomes necessary to maintain unduly large inventories of finished products, contrary to the current trend toward maintaining minimum inventory and frequently switching from production of one product to another.

SUMMARY OF THE INVENTION

In accordance with the present invention the aforementioned deficiencies of the prior art devices are overcome by providing a tube mill utilizing an automated procedure for selection of roll assemblies of the mill to change from production of one tubular product to another. The roll assemblies of the mill which are changed during the changeover procedure are mounted in the break down section.

The roll assemblies each include stand means, a lower forming roll member rotatingly journalled in the stand, a first upper forming roll member, a second upper forming roll member, a beam member, journal means rotatingly mounting the first and the second upper roll members in spaced relation to the beam, means mounting the beam member to the stand means, and indexing means for moving the beam to selectively position the first and second roll members in cooperative relation with the lower forming roll member.

DETAILED DESCRIPTION OF THE PREFERRED EMBODIMENTS

Figure 1:
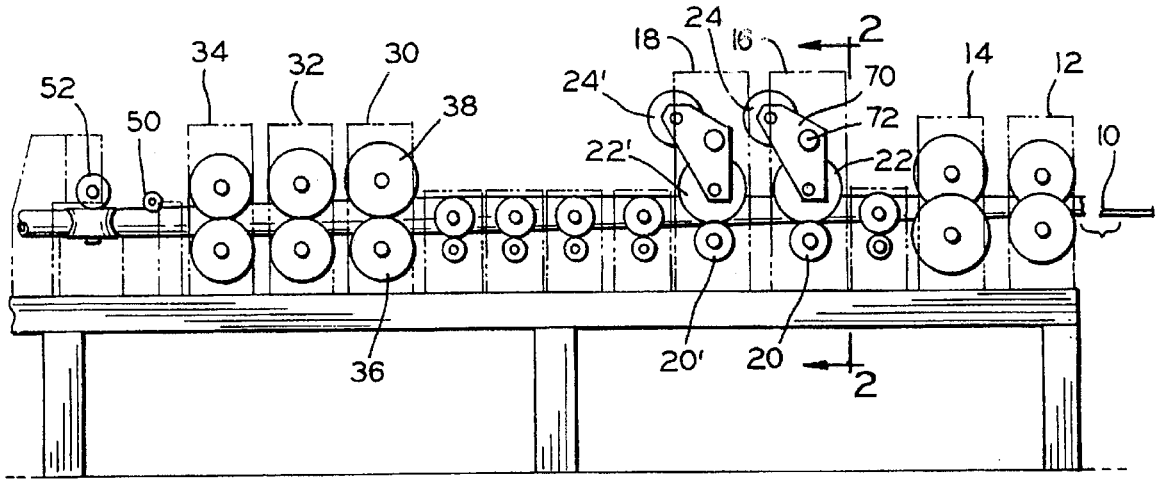
FIG. 1 is an elevational view of a tube mill embodying the features of the invention.
Figure 2:
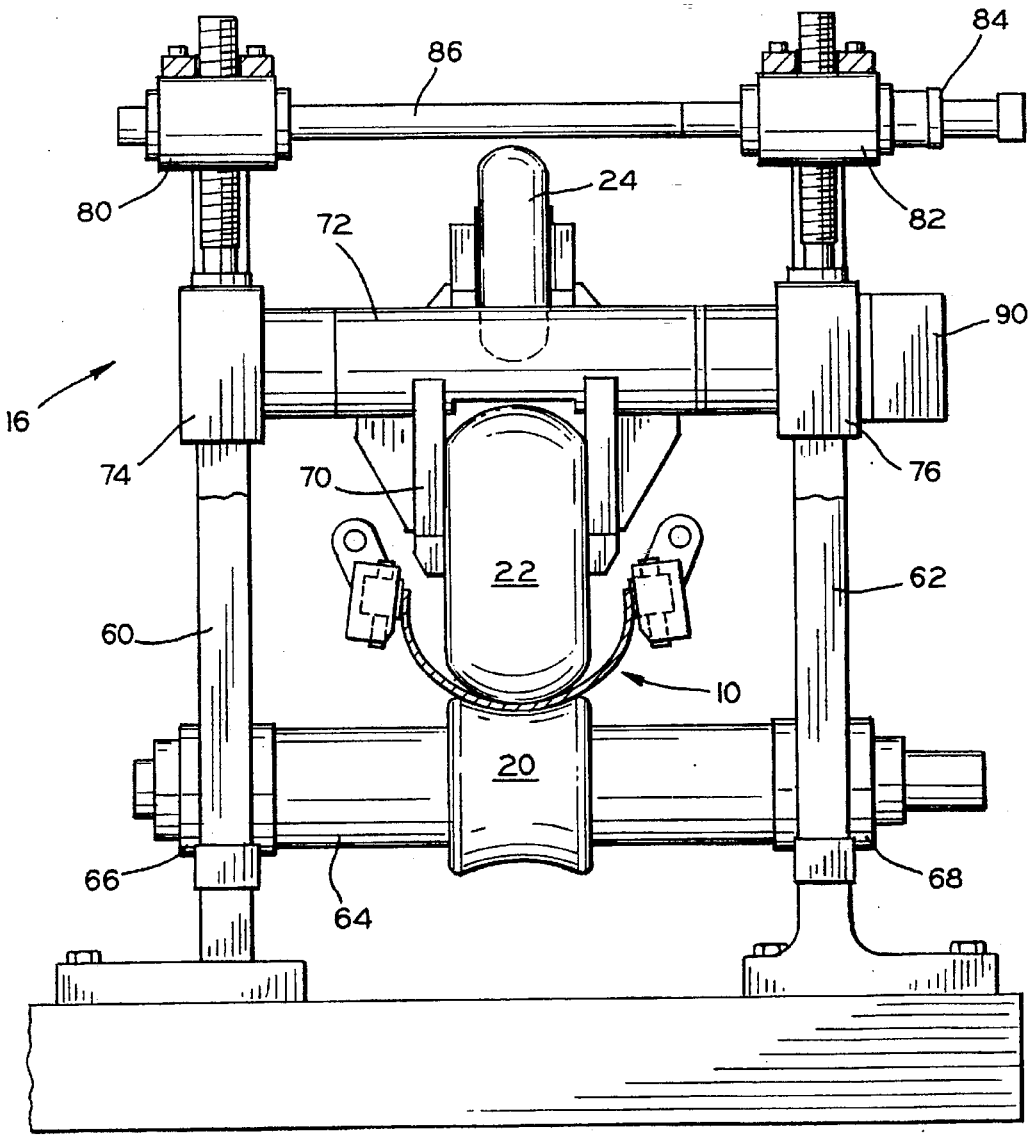
FIG. 2 is a sectional view of the invention taken along line 2—2 of FIG. 1.

Referring to the drawings, there is illustrated a tube mill for forming pipe or tube on a continuous basis from a strip of metal. More particularly, the reference numeral 10 shows a strip of sheet metal, such as cold rolled steel, for example, which is supplied from a supply coil (not shown). The strip 10 is fed into the input end of the tube mill by a pair of preform rollers 12 and 14 which define a pass line along which the strip travels and cooperate to commence the formation of the pipe or tube.

Spaced along the pass line from the guide rolls 12 and 14 are sequentially disposed breakdown roll stands 16 and 18. The breakdown roll stands are provided with cooperating forming rolls which function to progressively deform the strip preliminary to forming the final tube including additional shaping means located on opposite sides of the forming rolls for deflecting edges of the strip of material towards one another.

The breakdown roll stand 16 includes at least a pair of cooperating forming rolls 20 and 22. The next adjacent roll stand 18 includes at least a pair of cooperating forming rolls 20' and 22'. The breakdown rolls 20' and 22' are of a different contour than the rolls 20 and 22 to effect the gradual deformation of the initially flat strip 10 into a tube. The particular and specific contour of the forming rolls of the breakdown roll stands is a function of the width and thickness of the strip 10 being formed, the particular metal alloy of the strip 10, and the size of the ultimate tube being formed. It will be appreciated that the above parameters vary from one production run to another and, therefore, require corresponding changes in the make-up of the rolls of the breakdown roll stands. Heretofore, to accomplish the change in such tooling, at least the upper roll of the roll set of a stand required changing. Thus, necessitating the rather time consuming dismantling of the roll stand to provide access to the upper roll. Then manually manipulating the roll to be changed and transporting it to a remote storage area. Then a new roll was introduced into the roll stand. The roll stand was then reassembled in anticipation of the new production run. As an aside to the time consuming and difficult task of dismantling the roll stand to be changed, the manipulation of the forming roll requires a considerable degree of vulnerability toward physical mishap to the technicians assigned to the task. It must be understood that the forming rolls are extremely heavy, weighing several hundreds of pounds, are of a contour difficult to grasp, and typically covered with an oily and greasy lubricant applied to the rolls during the operation of the mill. All of these factors contribute to making the task of changing the forming rolls a very dangerous task wrought with possible physical harm.

After the strip 10, being formed, passes through the breakdown roll assemblies, it enters the next section of the mill oftentimes referred to as the fin roll section which consists of a plurality of fin roll stands 30, 32, 34. The fin roll stands complete the deformation of the strip 10 into a tubular form. The fin blade stand 30 typically is comprised of a lower driven forming roll 36 and a cooperating upper roll 38 having a fin roll (not shown) journalled to rotate independently in respect of the roll 38.

A seam guide roll stand 50 is spaced along the pass line from the fin roll section. The stand 50 is provided to maintain orientation of the seam of the tube being formed for direction into a welder. Typically, the stand 50 includes a fin blade adapted to contact the opposing edges of the partially formed tube as it exits the fin roll stand section to effectively maintain the seam edges in confronting relationship to one another prior to welding.

With the strip 10 in the condition provided by the seam roll guide 50, the seam is welded by means of a welder 52. Typically, the welder 52 is a high frequency induction type capable of introducing sufficient heat energy into the region of the abutting seams of the tube 10 to enable fusion thereof completing the formation of the tube from the flat strip 10. Although the welder 52 has been described as a high frequency induction type welder, it will be understood that other types of welders may be employed. Other alternatives include induction type welders which operate at different frequencies, tungsten inert gas (TIG), or lasers, for example.

The breakdown roll stands 16 and 18 accomplish the initial forming operation to determine the final size of the completed tubing. When it is desired to produce another size tubing, the mill is typically shut down. The breakdown roll stands are thence disassembled permitting access to the upper rolls of the forming roll assembly. The upper rolls are removed and transported to a suitable storage area and replaced with a differently configured upper roll which is required to produce selected size tubing. Finally, the roll stand is reassembled, permitting the mill operation to commence production of the newly selected size tubing.

The present invention is effective to overcome certain of the problems and time consumption of the above discussed changeover procedure. More specifically, the breakdown roll stands are provided with at least two upper rolls which may be readily changed to cooperate with the lower forming roll.

As clearly illustrated in the drawings, breakdown roll assembly 16 includes a pair of upstanding spaced apart stantions 60 and 62 each being suitably secured to the base of the mill. The lower forming roll 20 is mounted centrally between the stantions 60,62 on a shaft 64, the opposite ends of which are journalled by suitable bearing blocks 66,68, respectively, supported by the stantions 60,62.

The roll assembly 16 includes two upper rolls 22 and 24 which are rotatingly mounted in spaced relation on a beam 70. The beam 70 in turn is mounted on a composite shaft 72. The opposite end of the shaft 72 are journalled in bearing blocks 74,76 mounted for reciprocal movement on the stantions 60,62 respectively. Reciprocal vertical movement is achieved by lead screw and drive mechanism 80,82 which are simultaneously driven by a motor 84 coupled to an interconnecting drive shaft 86.

Figure 3:
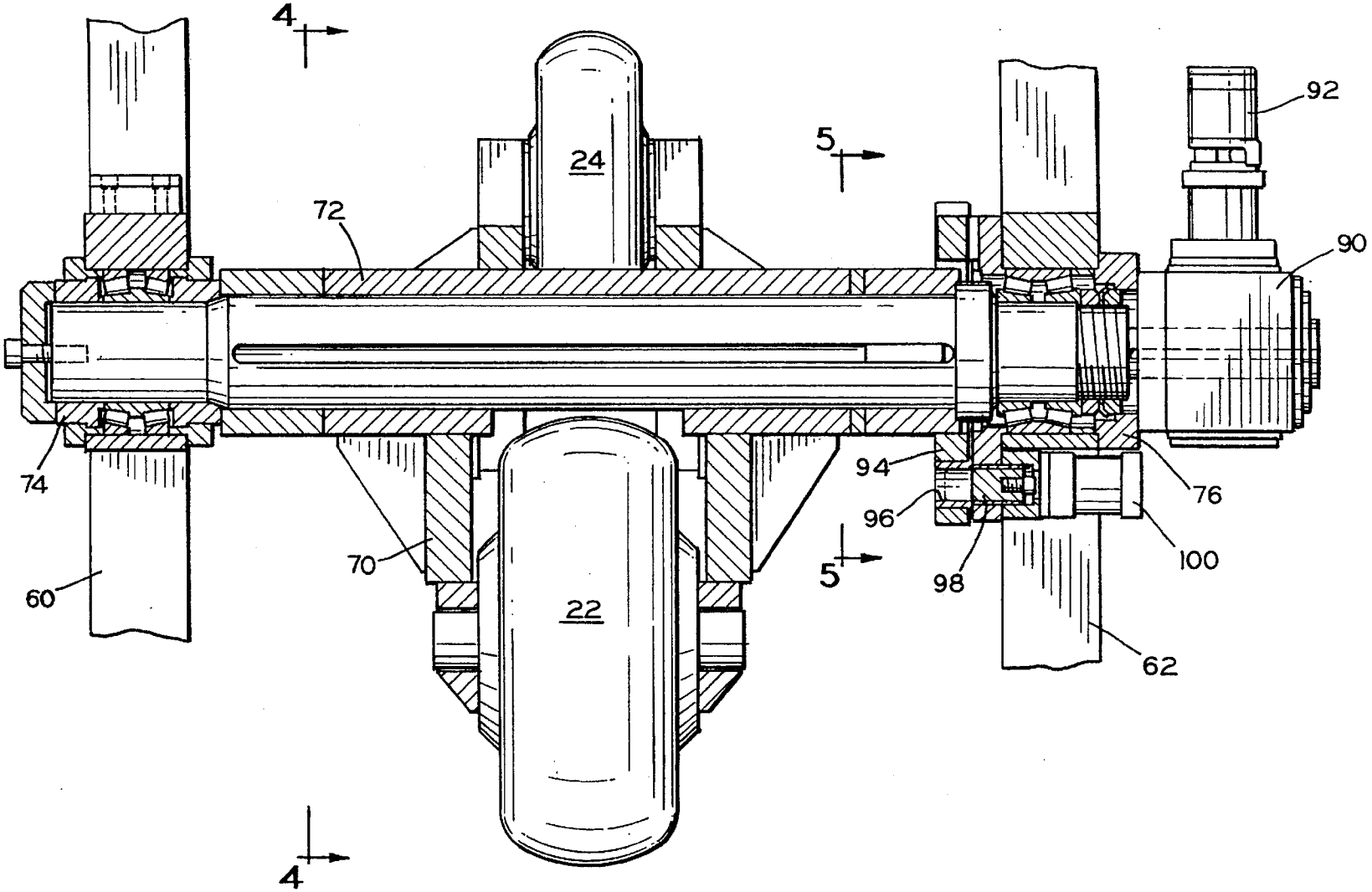
FIG. 3 is an enlarged fragmentary view partially in section of the upper roll assembly illustrated in FIG. 2.
Figure 4:
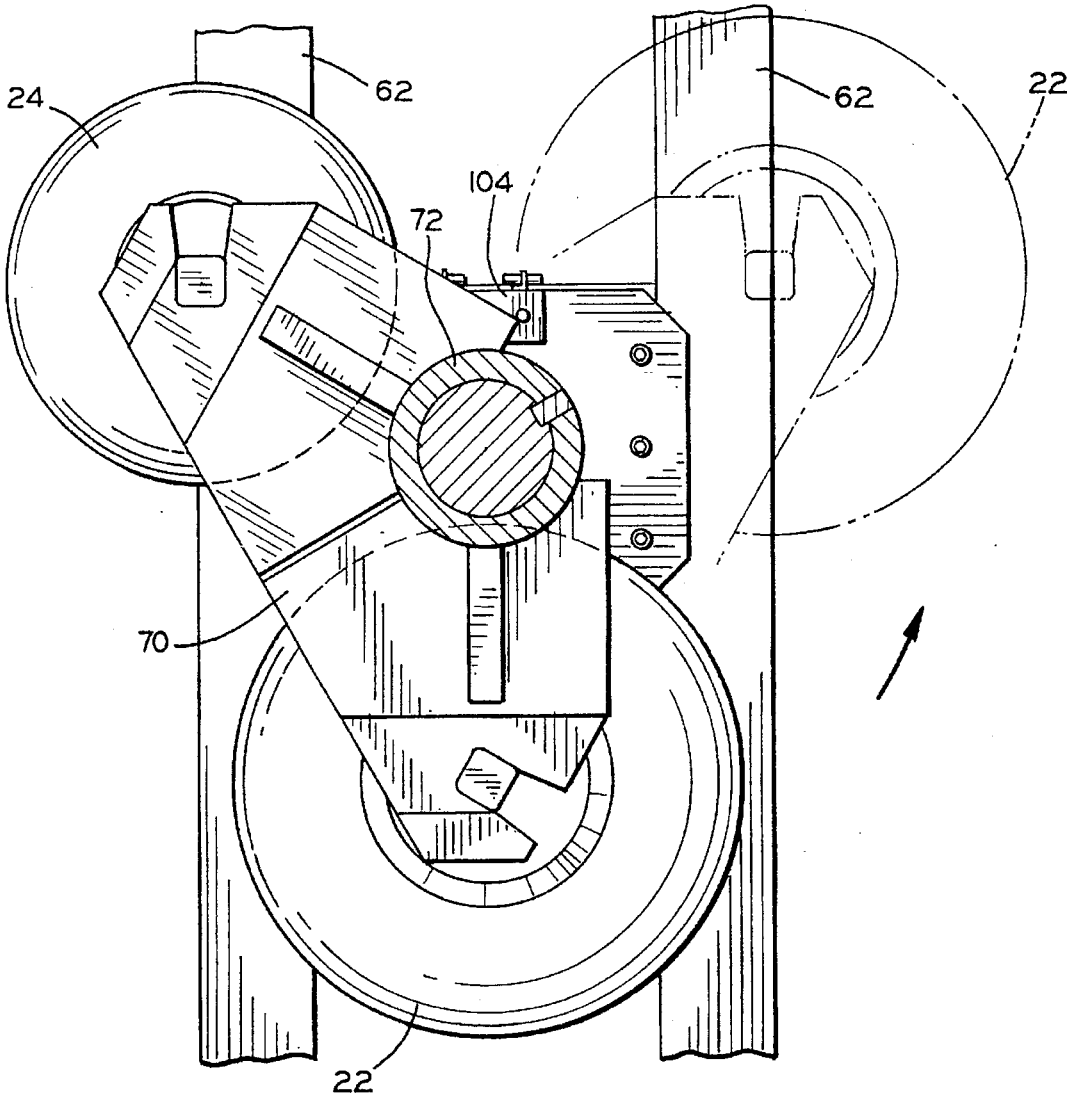
FIG. 4 is a sectional view taken along line 4—4 of FIG. 3.

The shaft 72 is connected to a reduction gear drive 90 which includes a hydraulic motor 92. The motor 92 can offset the desired rotational movement of the shaft 72 and the associated beam 70. In order to militate against the rotation of the shaft 72, there is provided a plurality of radially extending circumferentially spaced arms 94 each containing an apertured socket 96. The arms 94 are suitably affixed to and integral with the shaft 72. A plunger 98 and an associated air motor 100 are mounted on the bearing block 76. Normally, the plunger 98 is in the dotted line condition as illustrated in FIG. 3 wherein it is seated within a socket 96 of the arm 94 to prevent any relative rotation movement of the shaft 72 and the associated rolls 22 and 24, and the stantions 60,62.

Figure 5:
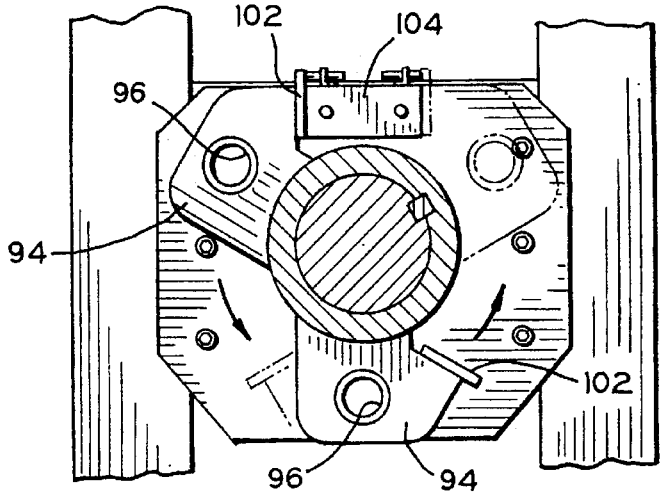
FIG. 5 is a sectional view taken along line 5—5 of FIG. 3.

Further, it will be noted from the examination of FIG. 5, the arms 94 are provided with pad members 102 adapted to selectively contact opposite ends of a stop block 104 and further rotation of the arms 94 during a changeover from the upper roll 22 to the substitute upper roll 24 or vice versa. When the above contact is made, the plunger 98 is caused to seat within the socket 96 to positively lock the shaft 72 from any further relative rotation movement until the next changeover procedure.

While the illustrated embodiment of the invention shows the use of two selectively usable forming rolls in the breakdown section of the mill, it will be understood by those skilled in the art that more than two forming roll selections may be employed.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A tube forming machine for the manufacture of metal tubing of varying outside diameters including means for gradually forming sheet material having an outer surface and an inner surface and having longitudinal edges into a substantially tubular shape by deflecting the edges towards one another and at least one breakdown roll assembly, the forming means and breakdown roll assembly being arranged to form the tubular shape along a path, said roll assembly including:

stand means;

a lower forming roll member journalled for rotation in said stand means, said lower forming roll member having a forming surface for contacting the outer surface of the metal of the tubing being formed;

a first upper forming roll member and a second upper forming roll member, said upper forming roll members each having a forming surface for contacting the inner surface of the metal of the tubing being formed;

a beam member;

journal means for rotatingly mounting said first and second upper forming roll members in spaced relation on said beam member;

means for rotatingly mounting said beam member to said stand means transversely to said path, said means including at least two radially extending circumferentially spaced arms, each of said arm provided with pad members;

indexing means for moving said beam to selectively position said first roll member or said second roll member in cooperative relation to said lower forming roll member, said indexing means including a stop block fixedly mounted to said stand means and having spaced apart oppositely facing ends, the ends adapted to be selectively engageable with the pad members of the arms of said means for rotatingly mounting said beam member to said stand member, and additional shaping means, separate from said lower forming roll member, arranged on opposite sides of the selected first or second upper forming roll members for deflecting the edges of the sheet material towards one another.

2. A tube forming machine as defined in claim 1 wherein said means for mounting said beam member to said stand includes means for selectively moving said beam member toward and away from said lower forming roll member.

3. A tube forming machine as defined in claim 2 wherein said means for selectively moving said beam member toward and away from said lower forming roll member includes a worm gear and lead screw drive.

* * * * *